United States Patent [19]

Mathieu et al.

[11] 4,011,037

[45] Mar. 8, 1977

[54] CONVEYOR BOAT FOR HIGH-TEMPERATURE CONTINUOUS FURNACE

[75] Inventors: Viktor Mathieu, Neuberg II; Reinhard Schäfer, Rodenbach I, both of Germany

[73] Assignee: Reaktor-Brennelement Union GmbH, Hanau, Germany

[22] Filed: May 15, 1975

[21] Appl. No.: 577,852

[30] Foreign Application Priority Data

May 27, 1974 Germany ..... 2425526

[52] U.S. Cl. ..... 432/258; 432/261

[51] Int. Cl.[2] ..... F27D 5/00

[58] Field of Search ..... 432/258, 261

[56] References Cited

UNITED STATES PATENTS

| | | | |
|---|---|---|---|
| 1,895,408 | 1/1933 | Davis | 432/258 |
| 2,297,286 | 9/1942 | Book | 432/258 |
| 2,879,577 | 3/1959 | Milburn | 432/258 |
| 3,553,800 | 1/1971 | Ploger | 432/261 |
| 3,632,095 | 1/1972 | Rode et al. | 432/261 |

*Primary Examiner*—John J. Camby

*Attorney, Agent, or Firm*—Kenyon & Kenyon Reilly Carr & Chapin

[57] ABSTRACT

A boat for carrying a load of stacked layers of interspaced pellets through a high-temperature continuous furnace, has a base for carrying the load through the furnace and having upstanding posts, each of the layers being carried by a sheet having holes through which the posts are inserted to prevent lateral shifting of the sheets.

3 Claims, 5 Drawing Figures

CONVEYOR BOAT FOR HIGH-TEMPERATURE CONTINUOUS FURNACE

BACKGROUND OF THE INVENTION

Sintered uranium dioxide pellets are loaded in cladding tubes to make fuel rods for the fuel rod assemblies forming the cores of nuclear reactors.

These pellets, and also other kinds of ceramic shapes, are produced by compressing the material in powder form, to form green compacts which are then sintered in high-temperature continuous furnaces.

A common type of continuous furnace is horizontal, has mutually opposite open ends, and a horizontal roller conveyor that extends through the furnace. The green compacts are loaded on boats in the form of stacked layers of compacts, and the boats are pushed over the roller bed and through the furnace, with one boat pushing the other so that the power means required to move the boat can be located outside of the furnace adjacent to the furnace's entrance end. To separate the layers, each layer is loaded on a carrier sheet so that when the boat is fully loaded each layer is separated by a carrier sheet.

The green compacts can be produced by automatic machinery, and if the carrier sheets are completely flat, they can be loaded by the compacts being pushed onto the sheets in automatic manner, eliminating any need for hand-loading.

As the boats are pushed through the furnace with each preceding boat being pushed by a succeeding boat, the boats receive a certain amount of jostling, this requiring that the sheets and compacts be restrained horizontally so that the sheets and compacts are carried safely through the furnace.

Such restraint has been provided by a box on the boat and made of thin sheet metal of sufficient height to accommodate the stacked layers of compacts with each layer loaded on a carrier sheet, the boat having four upstanding corner posts embraced by the corners of the box. The walls of the box are extensively perforated in an effort to assure that the furnace atmosphere, which must be inert with respect to the compacts at their sintering temperature, has complete access to the compacts.

The above prior art arrangement, incidentally, disclosed by German Pat. No. 1,583,749, is not completely satisfactory. Even though the box is made of the most heat-resistant metal that is commercially practical for use, the contour of the box is such that it is inherently subjected to warpage, keeping in mind that during the progress through the continuous furnace which normally includes both heating and cooling zones, the box is subjected to severe thermal stock. In addition, in spite of the perforations through the box walls, circulation of the furnace atmosphere through the stacked rows of sintered compacts, is substantially impeded, possibly resulting in changes in the chemical composition of the compact material.

The described prior art arrangement does have the advantage that the sheets can be made flat so that the automatic machinery producing the compacts can push the compacts onto the sheets so that manual loading of the sheets with the compacts, is avoided.

The desired disadvantages are particularly objectionable in connection with the sintering of uranium dioxide pellets used for the loading of nuclear reactor fuel rod cladding tubes, because of the necessity for holding the pellets exactly to their desired composition. In addition, the operation of any nuclear installation is extremely expensive and it is desirable to effect every possible economy, making the necessary replacement of the warped boxes made of expensive heat-resistant metal particularly undesirable. At the same time, considering the expense of uranium, any boat construction that might be considered as a substitute, should meet the requirements concerning automatic loading of the carrier sheets and free access of the furnace atmosphere to the stacked pellets, together with safe carriage through the continuous furnace.

SUMMARY OF THE INVENTION

With the foregoing in mind, the object of the present invention is to provide an improved boat which eliminates the disadvantages of the prior art boat while retaining its advantage concerning the ability to load the various carrier sheets automatically.

This object has been attained by making the base of the boat with upstanding posts, mounted on the base and which extend upwardly for the entire height of the stack of layers. The sheets are made with holes through which the posts can be inserted by lowering the sheets over the posts, thus holding the sheets against lateral displacement. To prevent the pellets or other compacts from falling sidewise off of the sheets, the sheets are made with bent-up edges which extend upwardly for a height substantially less than the height, or thickness, of the pellets or compacts, thus providing restraint while leaving extensive open areas between the edges of the bent-up portions and the next sheet above. To provide for the automatic loading, the posts and sheets are formed as two side-by-side groups with the adjacent bent edges portions of each two side-by-side sheets being bent-down portions which, as to each upper sheet, prevents horizontal shifting of the pellets or compacts on the next lower sheets, the remaining edge portions being the upwardly bent portions, the downwardly bent portions, again, being of less vertical extent than the height of the pellets or compacts.

In the above way the prior art box construction is completely avoided. The sheets can be loaded over their ends or edges having the bent-down portions. The initial construction cost is very substantially reduced. Because angularly bent portions of the sheets need not extend very far from the balance of the sheets, warpage problems are largely eliminated.

With this new boat, the furnace atmosphere flow to the pellets or compacts is substantially unimpeded. Although the boat's load is held securely against the jostling to be expected as each boat pushes the other through the continuous furnace, great uniformity of heating and cooling is obtained.

BRIEF DESCRIPTION OF THE DRAWINGS

The principles of the present invention are schematically illustrated by the accompanying drawings, in which.

DETAILED DESCRIPTION OF THE INVENTION

Figure 1:
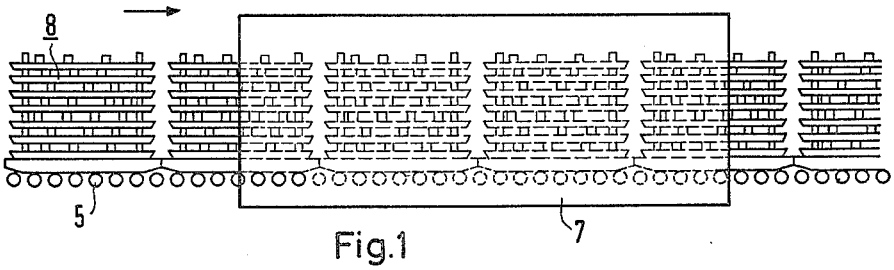
FIG. 1 in elevation represents a continuous furnace with its roller conveyor and with a train of the boats going through the furnace, each boat pushing the other.

Of the above drawings, FIG. 1 is provided mainly to show how a roller table 5 extends through the opposite open ends of a continuous high-temperature furnace 7, with the loaded boats 8 pushing each other over the roller table through the furnace. Although not illustrated, the furnace 7 normally comprises heating and cooling zones and for sintering uranium dioxide pellets the furnace temperature may be in the order of 1800 C and be filled with a protective atmosphere such as hydrogen. Although not shown, power means would be provided at the left-hand or entrance end of the furnace for pushing the far left-hand boat inwardly with each boat pushing the other into, through and out of the furnace.

Figure 2:
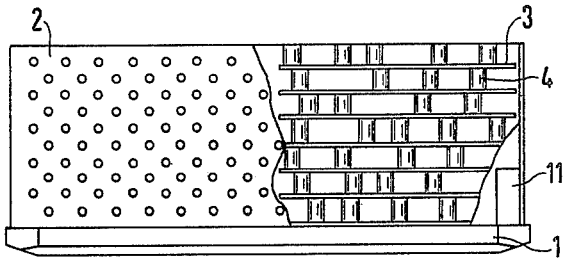
Fig.2 PRIOR ART
FIG. 2, in partially broken-away elevation view, shows the prior art boat.

The previously-referred-to prior art boat is shown by FIG. 2. The base 1 is a relatively thick slab having an appropriate contoured bottom and can be made relatively free from thermal warpage trouble. The box 2 is formed by the perforated walls and extends upwardly for the height of the stack of pellets, the corners of the box being engaged by vertical posts 11 mounted on the base 1, these posts necessarily being only high enough to anchor the box against horizontal shifting. The various flat sheets 3 on which the pellets 4 have been loaded, are shown with the box walls preventing horizontal displacement of both the sheets 3 and pellets 4. The pellets are green compacts compressed under high pressure and incidentally have the vertical strength required for the lower layers of pellets to carry the weight of the pellets and sheets above. The previously described disadvantages are readily apparent but, as can be seen, the sheets 3 are completely flat including their edge portions, permitting the automatic delivery of the compacted pellets 4, the pellets being simply shoved onto the carrier sheets with the latter being loaded, one at a time, into the box.

Figure 3:
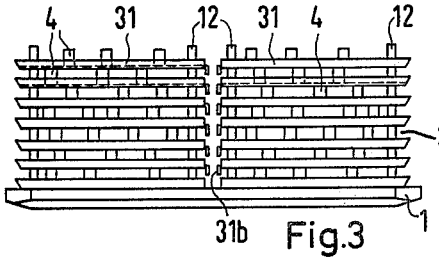
FIG. 3 in elevation shows an example of the boat of this invention, this being a side view.
Figure 4:
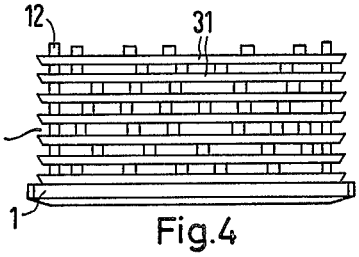
FIG. 4 is an end view of FIG. 3.
Figure 5:
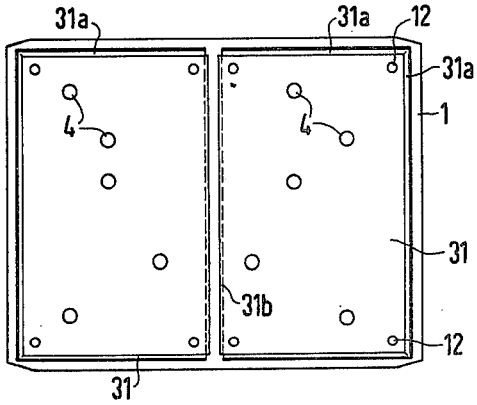
FIG. 5 is a plane view of FIG. 3.

The boat of the present invention is shown by FIGS. 3 through 5 and, in modified form, by FIG. 1.

As shown by FIGS. 3 through 5, the base or slab 1 may be made in the prior art manner, but with the difference that instead of the short posts 11, two groups of four posts each are used, the posts being indicated at 12. In this case the posts 12 extend upwardly for the full stack height. The sheets 31 which carry the pellets 4 are arranged as two side-by-side groups, the sheets of each group having corner holes through which the posts 12 are passed, thus preventing horizontal shifting of the sheets of each group. The side edge portions and the outer end portions of the sheets are bent upwardly to provide upwardly angling flanges 31*a*, while the two edges portions of the sheets which face each other, as to the two groups, are bent downwardly to provide downwardly extending flanges 31*b*. In all cases, the vertical extents of the flanges are substantially less than the height or vertical thickness of the pellets 4, thus leaving the peripheral open spaces 31*c* completely around the periphery of each layer of the two groups. The bent-up sheet peripheral portions and the bent-down portions, can have, respectively, and upward or downward angularity considered most advantageous from the viewpoints of easy fabrication and resistance to thermal warping problems, providing the angularities are adequate to prevent the pellets from horizontally shifting off of the sheets and over their edge portions.

It can be seen that because each sheet has one free end or side insofar as the bent-up portions are concerned, that the sheets can be automatically loaded with the pellets as easily as in the case of the flat sheets of the prior art FIG. 2 arrangement. The bent-down portions hold the pellets on the next longer sheet, in each instance, from shifting inwardly, while the bent-up portions of each sheet provide horizontal restraint for the pellets on that sheet, in all other directions.

In the case of the top one of the sheets 31, loss of the pellets in the direction towards the space between the two groups, is prevented it the two groups have their respective sheets positioned adequately adjacent to each other. With greater spacing between the two groups, the uppermost one of the sheets of each group can be left unloaded.

In one specific example of this invention, the base 1 has a thickness of from 2 to 3 cm with its horizontal dimensions being about 20 by 30 cm. The posts are made high enough so that in the case of uranium dioxide pellets of about 10 mm in diameter and height, up to seven conveyor sheets may be used for each stack so that each boat can be carry about 28 kg through the sintering furnace. The conveyor sheets 31 are made of molybdenum alloy about 1.5 mm thick, the height or vertical extents of all the angular bent peripheral sheet portions being about 7 mm. The mounting posts 12 are, of course, made high enough to accommodate the number of sheets involved. The posts are also made of molybdenum alloy. The objectionable warping does not occur with loaded boats pushed through a typical sintering furnace operating at temperatures of about 1800° C.

With the flange or bent sheet peripheries of the extent noted, it can be seen that completely around each layer of pellets there is an approximately 3 mm peripheral space. Because the space is peripherally continuous, it does not impede the flow of furnace atmosphere through the layers to anything like the same extent that occurred in the case of the prior art box construction. Variations in the as-sintered density of the pellets is substantially less due to the more uniform heat exchange available with this new construction. Because of the better access to the pellets on the part of the furnace gas, normally hydrogen, there is far less danger of crack formation or density drops on the part of the sintered pellets, such trouble normally occurring in the case of pellets of the higher oxygen-uranium ratios. Water vapor that forms from the hydrogen is removed more rapidly than before, it being understood that the furnace atmosphere is caused to circulate within the sintering furnace.

The 3 mm peripheral space referred to, has reference only to the vertical direction. As shown by FIGS. 3 and 4, the bent edge portions need not be at right angles to the horizontal planes of the sheets. For example, although the flanges or bent-down portions 31*b* are shown at right angles to the sheet planes, the flanges or bent-up portions 31*a* are shown as having angularities of about 60° or, in other words, as being angled outwardly so that while providing adequate pellet restraint, the peripheral spaces defined by the flanges 31*a* and the next upper sheets, are 3 mm in vertical extent, but while providing horizontal clearance between each two of the sheets, thus increasing the cross-sections open to the furnace atmosphere flow.

What is claimed is:

1. A boat for carrying a load of stacked layers of interspaced pellets through a high-temperature continuous furnace, the boat comprising a horizontal base for carrying the load, a plurality of upstanding posts mounted on the base, and a plurality of sheets having holes through which the posts are passed to hold the sheets against horizontal shifting, the sheets being adapted to be individually interposed between each two of said layers and having edge shapes leaving the periphery of each of the layers horizontally free for a substantial portion of each layers's height, said edge shapes comprising angularly bent-edge portions of the sheets, said portions being adapted to have less vertical extent than the layer's height but the extent being adequate to prevent the pellets from falling side-wise over the peripheries of the sheets, said posts and said sheets forming two side-by-side groups and the adjacent bent edges portions of each two side-by-side sheets, comprising bent-down edge portions, the balance of the sheets bent-edge portions being bent-up edge portions.

2. The boat of claim 1 in which said base, posts and sheets are made of a heat-resistant metal alloy, and said sheets are flat inwardly of their said edge portions so that the pellets can be vertically positioned.

3. The boat of claim 2 in which said bent-up edge portions are angled outwardly.

* * * * *